US006304193B1

(12) United States Patent
Behrens

(10) Patent No.: US 6,304,193 B1
(45) Date of Patent: Oct. 16, 2001

(54) DEVICE FOR MONITORING TRAFFIC

(75) Inventor: Andreas Behrens, Langenfeld (DE)

(73) Assignee: Robot Foto und Electronic GmbH, Dusseldorf (DE)

( * ) Notice: Subject to any disclaimer, the term of this patent is extended or adjusted under 35 U.S.C. 154(b) by 0 days.

(21) Appl. No.: 09/552,343

(22) Filed: Apr. 19, 2000

(30) Foreign Application Priority Data

Apr. 28, 1999 (DE) ..... 199 19 248

(51) Int. Cl.[7] ..... G08G 1/01

(52) U.S. Cl. ..... 340/933; 340/937; 340/936; 340/449; 340/935; 340/995; 348/148; 348/149

(58) Field of Search ..... 340/933, 937, 340/936, 449, 935, 995; 348/148, 149

(56) References Cited

U.S. PATENT DOCUMENTS 4,314,232 * 2/1982 Tsunoda ..... 340/52 F
4,988,994 * 1/1991 Loeven ..... 340/936
5,221,956 * 6/1993 Patterson et al. ..... 356/28
5,381,155 * 1/1995 Gerber ..... 342/104
5,515,042 * 5/1996 Nelson ..... 340/937
5,521,696 * 5/1996 Dunne ..... 356/5.07
5,767,794 * 6/1998 Borsch et al. ..... 370/937
5,948,038 * 9/1999 Daly et al. ..... 701/117

* cited by examiner

*Primary Examiner*—Daniel J. Wu
*Assistant Examiner*—Tai T. Nguyen
(74) *Attorney, Agent, or Firm*—Lawrence G. Fridman

(57) ABSTRACT

A device for monitoring traffic is designed as a portable hand-held device and includes a measuring unit for measuring a traffic state such as speed of a vehicle, a microphone and a language or voice recorder. Furthermore, the device has a language generator which acoustically outputs the measuring result of the measuring unit. The acoustically output measuring result is also recorded by the language or voice recorder. This permits acoustic documentation of the measuring procedure and its circumstances.

7 Claims, 1 Drawing Sheet

DEVICE FOR MONITORING TRAFFIC

BACKGROUND OF THE INVENTION

The invention relates to a device for monitoring traffic with a measuring device for measuring a traffic state of a vehicle.

The traffic state of the vehicle may be the speed of the vehicle. The measuring device may, however, also be adapted to measure the tyre profile or some other measurable traffic-related state of the vehicle.

Conventional devices for traffic monitoring include a photographic camera, which photographically documents violations of traffic regulations. Such photographic documents which show the monitored vehicle and the measuring data reflected into the picture and imaged thereon can be used in court trial. Usually, such documents are acknowledged by the court as evidence. There are, however, also portable hand-held devices for mobile measurement of the speed of a vehicle, such hand-held devices usually operating with a laser speed measuring device. Such hand-held devices display a measured value but do not provide photographic documentation. Then, in a court proceedings, the traffic officer has to be heard as a witness. Such hearing of a witness presents problems. Sometimes, the court trial takes place months after the event. Since then, the office is likely to have made hundreds of measurements. In general, he cannot swear that he still has exact recollection of details of the measuring procedure.

It is an object of the invention to improve the ability of a device for monitoring traffic to provide acceptable evidence of traffic violations.

This is achieved by a device for monitoring traffic with a measuring device for measuring a traffic state of a vehicle, wherein said device includes pick-up means for picking up language, and means for recording such picked-up language.

This permits the officer to verbally input information about the detailed circumstances of the measuring procedure. Such circumstances may include the time and location of the measurement, the measured value but also the color of the vehicle measured, street or traffic conditions etc. On the basis of these language recordings, the officer is able to confirm the circumstances of his measurement with greater reliability during a court trial.

DESCRIPTION OF THE PREFERRED EMBODIMENT

Figure 1:
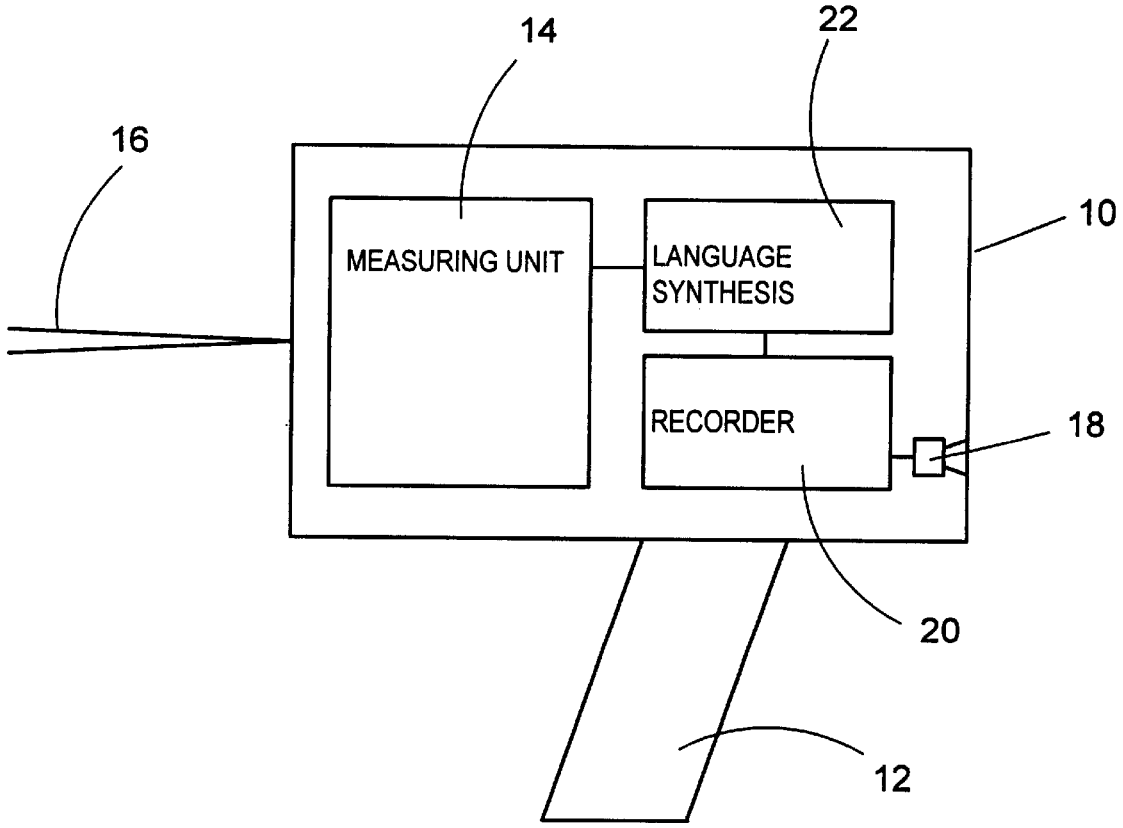
FIG. 1 is a schematic drawing showing a device for measuring speed of a vehicle according to the invention.

An embodiment of the invention will now be described in greater detail with reference to the accompanying drawing.

The drawing schematically shows a device for measuring the speed of vehicles, which device includes a microphone or a language or voice recorder.

The device is a hand-held device with a housing 10. The housing 10 has a handle 12. A measuring unit 14 is mounted in the housing 10. The measuring unit 14 is a laser speed measuring device. The measuring unit 14 emits a laser beam 16 which is directed to a vehicle to be measured. The speed of the vehicle can be determined by the measuring unit 14 from the laser light reflected by the vehicle. This is well-known technology and, therefore, is not described in detail.

A microphone 18 is provided at the housing 10. The microphone 18 is connected to a language or voice recorder 20. Also such language or voice recorders are well-known devices which need not be described in further detail here.

Furthermore, A device 22 for language sythesis is mounted in the housing. This device 22 for language synthesis, is connected, on one hand, to the measuring device 14 and, on the other hand, to the language or voice recorder 20. The device 22 for language synthesis can provide acoustic instructions for the operation of the device. Furthermore, the device 22 for language synthesis outputs acoustically, in language form, data which are provided by the measuring unit 14 such as date, local time and measured value (speed). Also such language synthesizers for outputting data in language form are known to a person skilled in the art and need not be described in detail here.

The device described above may, for example, operate as follows:

The measuring procedure is initiated by pushing a key (not shown). Then the device 22 for language synthesis provides acoustic instructions for the measuring procedure with the measuring unit 14: "Please aim at the measured object". The traffic officer may then speak his comments to the measuring procedure: "Aimed at licence number of white Opel Astra". "No further vehicle within the field of measurement". "Licence number XE-LL-83". After the measuring procedure has been completed, the measuring unit 14 provides, through the device for language synthesis, information relating to the measuring procedure itself: "Jan. 25, 1999, 8.30, measured speed 83 km/h".

The acoustic information given by the officer and those provided by the measuring unit 14 are recorded together by the language or voice recorder. The recording may be analog or digital. At the same time, time and measurement information can be stored separately but in fixed association with the language recordings by the language recorder. This may be done in digital form on a second sound track of a recording medium.

After digitalization of the acoustic information and a subsequent compression of the sound data, the sound or language document may be stored in a computer as a file or part of a file. The computer may be an integral component of the device or an external computer.

A sound track carrier is also provided which includes a first sound track and a second sound track. The recording means or recorder 20 includes means for recording the language or audible speech observations on the first track. The device for monitoring traffic further comprises means for recording the acoustically outputted data generated by the device for measuring a traffic state on the second sound track.

I claim:

1. A hand-held device for monitoring traffic, comprising:

a hand-held housing;

a measuring device for measuring of and generating data related to a traffic state of a vehicle without producing a vehicle-identifying video image, said measuring device being at least partially situated within said hand-held housing;

said measuring device including pick-up means for picking up audible speech observations and recording means for recording said audible speech observations;

a sound track carrier including a first sound track and a second sound track, said recording means including means for a recording said audible speech observations on said first track;

and said device for monitoring traffic further comprising means for recording said data generated by said measuring device on said second sound track.

2. A device as claimed in claim 1, wherein said pick-up means comprises a microphone.

3. A device as claimed in claim 1, wherein said measuring device comprises means for measuring speed of a vehicle.

4. A device as claimed in claim 3, wherein said speed measuring means is a laser speedometer.

5. A device as claimed in claim 1, wherein said device further comprises language generator means.

6. A device as claimed in claim 1, further comprising means for storing said data generated by said measuring device in association with audible speech observations simultaneously recorded by said recording means.

7. A device as claimed in claim 1, wherein said measuring device further comprises a data to voice synthesizer, whereby said synthesizer being controlled by said measuring device to acoustically output said data generated by said measuring device, said acoustically outputted measuring data being recorded on said second sound track.

* * * * *